US008323053B2

(12) United States Patent
Montena

(10) Patent No.: US 8,323,053 B2
(45) Date of Patent: Dec. 4, 2012

(54) CONNECTOR HAVING A CONSTANT CONTACT NUT

(75) Inventor: Noah Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 144 days.

(21) Appl. No.: 12/906,559

(22) Filed: Oct. 18, 2010

(65) Prior Publication Data

US 2012/0094532 A1 Apr. 19, 2012

(51) Int. Cl.
*H01R 9/05* (2006.01)

(52) U.S. Cl. ..... 439/578; 439/584

(58) Field of Classification Search ..... 439/578, 439/584; D13/154
See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,102,495 | A | 12/1937 | England |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,015,794 | A | 1/1962 | Kishbaugh |

(Continued)

FOREIGN PATENT DOCUMENTS

CA 2096710 A1 11/1994

(Continued)

OTHER PUBLICATIONS

Notice of Allowance (Mail Date: Oct. 18, 2011) for U.S. Appl. No. 12/906,503, filed Oct. 18, 2010.

(Continued)

*Primary Examiner* — Hae Moon Hyeon
(74) *Attorney, Agent, or Firm* — Schmeiser, Olsen & Watts, LLP

(57) ABSTRACT

A connector comprising a connector body attached to a post, the post including a first end portion and an opposing second end portion, and a flange proximate the second end portion, a port coupling element rotatably attached to the post, wherein the port coupling element has a first end and a second end, and a plurality of openings on the port coupling element, the plurality of openings extending a distance toward the first end from the second end of the port coupling element. Furthermore, a method of maintaining ground continuity in a connector comprising the steps providing a connector body attached to a post, the post having a first end, an opposing second end, and port coupling element having a plurality of openings positioned thereon, and biasing the port coupling element in a position of interference with the post is also provided.

21 Claims, 4 Drawing Sheets

U.S. PATENT DOCUMENTS

| | | | |
|---|---|---|---|
| 3,091,748 | A | 5/1963 | Takes et al. |
| 3,094,364 | A | 6/1963 | Lingg |
| 3,184,706 | A | 5/1965 | Atkins |
| 3,194,292 | A | 7/1965 | Borowsky |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,022,966 | A | 5/1977 | Gajajiva |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,490,576 | A | 12/1984 | Bolante et al. |
| 4,506,943 | A | 3/1985 | Drogo |
| 4,515,427 | A | 5/1985 | Smit |
| 4,525,017 | A | 6/1985 | Schildkraut et al. |
| 4,531,790 | A | 7/1985 | Selvin |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |

4,596,435 A 6/1986 Bickford
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A 4/1987 Stursa
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,747 A 10/1991 Bawa et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A * 3/1993 Szegda ..... 439/394
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.

5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hse
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,769 A 4/2000 Kubota et al.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,767,248 B1 7/2004 Hung
6,769,926 B1 * 8/2004 Montena ..... 439/253
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,929,508 B1 8/2005 Holland
6,939,169 B2 9/2005 Islam et al.
6,971,912 B2 * 12/2005 Montena et al. ..... 439/578
7,029,326 B2 4/2006 Montena
7,070,447 B1 7/2006 Montena
7,070,477 B2 7/2006 Morisawa et al.
7,086,897 B2 * 8/2006 Montena ..... 439/578
7,097,499 B1 8/2006 Purdy
7,102,868 B2 9/2006 Montena
7,114,990 B2 10/2006 Bence et al.
7,118,416 B2 * 10/2006 Montena et al. ..... 439/584
7,125,283 B1 10/2006 Lin
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,229,303 B2 6/2007 Vermoesen et al.
7,252,546 B1 8/2007 Holland
7,255,598 B2 8/2007 Montena et al.
7,299,550 B2 11/2007 Montena
7,375,533 B2 5/2008 Gale
7,393,245 B2 7/2008 Palinkas et al.
7,404,737 B1 7/2008 Youtsey
7,452,239 B2 11/2008 Montena
7,455,550 B1 * 11/2008 Sykes ..... 439/584
7,462,068 B2 12/2008 Amidon
7,476,127 B1 1/2009 Wei
7,479,035 B2 1/2009 Bence et al.
7,488,210 B1 2/2009 Burris et al.
7,494,355 B2 2/2009 Hughes et al.
7,497,729 B1 3/2009 Wei
7,507,117 B2 3/2009 Amidon
7,544,094 B1 6/2009 Paglia et al.
7,566,236 B2 7/2009 Malloy et al.
7,607,942 B1 10/2009 Van Swearingen
7,674,132 B1 3/2010 Chen
7,682,177 B2 3/2010 Berthet
7,727,011 B2 * 6/2010 Montena et al. ..... 439/578
7,753,705 B2 7/2010 Montena
7,753,727 B1 7/2010 Islam et al.
7,794,275 B2 9/2010 Rodrigues
7,806,714 B2 10/2010 Williams et al.
7,806,725 B1 10/2010 Chen

| | | | | |
|---|---|---|---|---|
| 7,811,133 | B2 | 10/2010 | Gray | |
| 7,824,216 | B2 * | 11/2010 | Purdy | 439/578 |
| 7,828,595 | B2 | 11/2010 | Mathews | |
| 7,830,154 | B2 | 11/2010 | Gale | |
| 7,833,053 | B2 | 11/2010 | Mathews | |
| 7,845,976 | B2 | 12/2010 | Mathews | |
| 7,845,978 | B1 | 12/2010 | Chen | |
| 7,850,487 | B1 | 12/2010 | Wei | |
| 7,857,661 | B1 | 12/2010 | Islam | |
| 7,887,354 | B2 | 2/2011 | Holliday | |
| 7,892,004 | B2 | 2/2011 | Hertzler et al. | |
| 7,892,005 | B2 | 2/2011 | Haube | |
| 7,892,024 | B1 | 2/2011 | Chen | |
| 7,927,135 | B1 | 4/2011 | Wlos | |
| 7,950,958 | B2 | 5/2011 | Mathews | |
| 7,955,126 | B2 | 6/2011 | Bence et al. | |
| 7,972,158 | B2 | 7/2011 | Wild et al. | |
| 8,029,315 | B2 | 10/2011 | Purdy et al. | |
| 8,062,044 | B2 | 11/2011 | Montena et al. | |
| 8,075,338 | B1 * | 12/2011 | Montena | 439/578 |
| 8,079,860 | B1 * | 12/2011 | Zraik | 439/255 |
| 8,152,551 | B2 | 4/2012 | Zraik | |
| 8,167,635 | B1 | 5/2012 | Mathews | |
| 8,167,636 | B1 | 5/2012 | Montena | |
| 8,167,646 | B1 | 5/2012 | Mathews | |
| 8,172,612 | B2 | 5/2012 | Bence et al. | |
| 8,192,237 | B2 | 6/2012 | Purdy et al. | |
| 2002/0013088 | A1 | 1/2002 | Rodrigues et al. | |
| 2002/0038720 | A1 | 4/2002 | Kai et al. | |
| 2003/0214370 | A1 | 11/2003 | Allison et al. | |
| 2003/0224657 | A1 | 12/2003 | Malloy | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0208827 | A1 | 9/2005 | Burris et al. | |
| 2005/0233636 | A1 | 10/2005 | Rodrigues et al. | |
| 2006/0099853 | A1 | 5/2006 | Sattele et al. | |
| 2006/0105628 | A1 * | 5/2006 | Montena | 439/578 |
| 2006/0110977 | A1 | 5/2006 | Mathews | |
| 2006/0154519 | A1 | 7/2006 | Montena | |
| 2007/0026734 | A1 | 2/2007 | Bence et al. | |
| 2007/0049113 | A1 | 3/2007 | Rodrigues et al. | |
| 2007/0123101 | A1 | 5/2007 | Palinkas | |
| 2007/0155232 | A1 | 7/2007 | Burris et al. | |
| 2007/0175027 | A1 | 8/2007 | Khemakhem et al. | |
| 2007/0243759 | A1 | 10/2007 | Rodrigues et al. | |
| 2007/0243762 | A1 | 10/2007 | Burke et al. | |
| 2008/0102696 | A1 | 5/2008 | Montena | |
| 2008/0289470 | A1 | 11/2008 | Aston | |
| 2009/0029590 | A1 | 1/2009 | Sykes et al. | |
| 2009/0098770 | A1 | 4/2009 | Bence et al. | |
| 2010/0055978 | A1 * | 3/2010 | Montena | 439/583 |
| 2010/0081321 | A1 | 4/2010 | Malloy et al. | |
| 2010/0081322 | A1 | 4/2010 | Malloy et al. | |
| 2010/0105246 | A1 | 4/2010 | Burris et al. | |
| 2010/0233901 | A1 | 9/2010 | Wild et al. | |
| 2010/0233902 | A1 * | 9/2010 | Youtsey | 439/578 |
| 2010/0255720 | A1 | 10/2010 | Radzik et al. | |
| 2010/0255721 | A1 | 10/2010 | Purdy et al. | |
| 2010/0279548 | A1 | 11/2010 | Montena et al. | |
| 2010/0297871 | A1 | 11/2010 | Haube | |
| 2010/0297875 | A1 | 11/2010 | Purdy | |
| 2011/0021072 | A1 | 1/2011 | Purdy | |
| 2011/0027039 | A1 | 2/2011 | Blair | |
| 2011/0053413 | A1 | 3/2011 | Mathews | |
| 2011/0117774 | A1 | 5/2011 | Malloy et al. | |
| 2011/0143567 | A1 | 6/2011 | Purdy et al. | |
| 2011/0230089 | A1 | 9/2011 | Amidon et al. | |
| 2011/0230091 | A1 | 9/2011 | Krenceski et al. | |
| 2012/0021642 | A1 | 1/2012 | Zraik | |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| DE | 4439852 | A1 | 5/1996 |
| DE | 19957518 | A1 | 9/2001 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1548898 | | 6/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 2002075556 | A | 3/2002 |
| JP | 3280369 | B2 | 5/2002 |
| JP | 4503793 | B9 | 4/2010 |
| KR | 100622526 | B1 | 9/2006 |
| TW | 427044 | B | 3/2001 |
| WO | 8700351 | | 1/1987 |
| WO | 0186756 | A1 | 11/2001 |
| WO | 02069457 | A1 | 9/2002 |
| WO | 2004013883 | A2 | 2/2004 |
| WO | 2006081141 | A1 | 8/2006 |
| WO | 2011128665 | A1 | 10/2011 |
| WO | 2011128666 | A1 | 10/2011 |

OTHER PUBLICATIONS

U.S. Appl. No. 12/906,503, filed Oct. 18, 2010.

Digicon AVL Connector. ARRIS Group Inc. [online]. 3 pages. [retrieved on Apr. 22, 2010]. Retrieved from the Internet:<URL: http://www.arrisi.com/special/digiconAVL.asp>.

Office Action (Mail Date: May 31, 2011) for U.S. Appl. No. 12/906,503, filed Oct. 18, 2010, Conf. No. 1212.

* cited by examiner

CONNECTOR HAVING A CONSTANT CONTACT NUT

CROSS-REFERENCE TO RELATED APPLICATIONS

This application is related to U.S. patent application Ser. No. 12/906,503, filed on Oct. 18, 2010, now U.S. Pat. No. 8,075,338 entitled "Connector Having a Constant Contact Post," the contents of which are incorporated in its entirety.

FIELD OF THE INVENTION

The present invention relates to connectors used in coaxial cable communication applications, and more specifically to embodiments of a coaxial cable connector having a constant contact nut that extends electrical continuity through the connector.

BACKGROUND OF THE INVENTION

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference. Connectors for coaxial cables are typically connected onto complementary interface ports to electrically integrate coaxial cables to various electronic devices and cable communication equipment. Connection is often made through rotating an internally threaded nut of the connector about a corresponding externally threaded interface port. Fully tightening the threaded connection of the coaxial cable connector to the interface port helps to ensure a ground connection between the connector and the corresponding interface port. However, connectors are often times not properly tightened or otherwise installed. Moreover, the structure of common connectors may permit loss of ground and discontinuity of the electromagnetic shielding that is intended to be extended from the cable, through the connector, and to the corresponding coaxial cable interface port.

Hence, a need exists for an improved connector having a constant contact nut for ensuring ground continuity through the connector, and establishing and maintaining electrical and physical communication between the post and a port coupling element, such as a nut.

SUMMARY OF THE INVENTION

A first general aspect of the invention provides a connector comprising a connector body attached to a post, the post including a first end portion and an opposing second end portion, and a flange proximate the second end portion, a port coupling element attached to the post, the port coupling element being rotatable about the post, wherein the port coupling element has a first end and a second end, and a plurality of openings on the port coupling element, the plurality of openings extending a distance toward the first end from the second end of the port coupling element.

A second general aspect of the invention provides a coaxial cable connector comprising a connector body attached to a post, the post having a first end portion, an opposing second end portion, and a flange proximate the second end portion, the flange having an outer edge, a port coupling element rotatable about the post, wherein the port coupling element includes a first end and a second end, and a plurality of engagement fingers proximate the second end, wherein the plurality of engagement fingers are biased into a position of interference with the post.

A third general aspect of the invention provides a connector comprising a slotted port coupling element attached to a post, the slotted port coupling element having a first end, an opposing second end, wherein the slotted port coupling element is resilient in the radial direction, and a connector body attached to the post, the post having a first end portion, an opposing second end portion, wherein a positioning of the post radially expands the slotted port coupling element, further wherein the slotted port coupling element exerts an opposing radial contact force against an outer surface of the post, wherein the opposing radial contact force establishes and maintains physical and electrical contact between the slotted port coupling element and the post regardless of the axial position of the post and the slotted port coupling element.

A fourth general aspect of the invention provides a method of maintaining ground continuity in a connector providing a connector body attached to a post, the post having a first end, an opposing second end, and port coupling element having a plurality of openings positioned thereon, and biasing the port coupling element in a position of interference with the post.

A fifth general aspect of the invention provides a method of maintaining electrical continuity with a port comprising providing a connector body attached to a post, the post having a first end portion and an opposing second end portion, a port coupling element rotatable about the post, wherein the port coupling element has a first end and a second end, and a plurality of engagement fingers proximate the second end, the plurality of engagement fingers being resilient in a radial direction, and expanding the plurality of engagement fingers in a radially outward direction, wherein the expansion of the plurality of engagement fingers by a positioning of the post results in the plurality of engagement fingers exerting a radially inward force against the port coupling element, wherein the radially inward force against the port coupling element establishes and maintains physical and electrical continuity between the post and the port coupling element regardless of the relative axial position between the post and the port coupling element.

The foregoing and other features of construction and operation of the invention will be more readily understood and fully appreciated from the following detailed disclosure, taken in conjunction with accompanying drawings.

BRIEF DESCRIPTION OF THE DRAWINGS

Some of the embodiments of this invention will be described in detail, with reference to the following figures, wherein like designations denote like members, wherein.

DETAILED DESCRIPTION OF THE DRAWINGS

Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1:
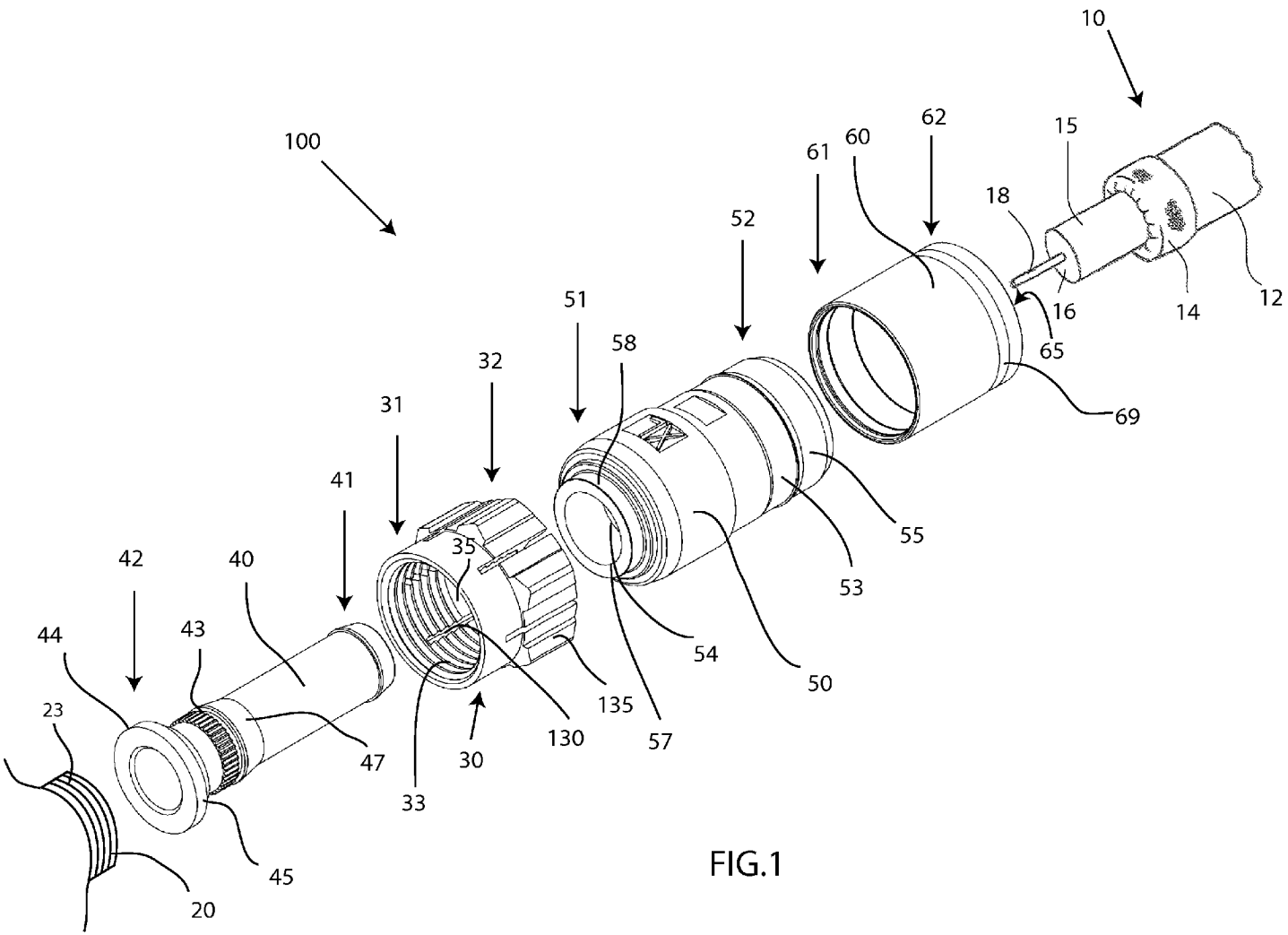
FIG. 1 depicts an exploded perspective cut-away view of an embodiment of the elements of an embodiment of a coaxial cable connector, in accordance with the present invention.

Referring to the drawings, FIG. 1 depicts one embodiment of a coaxial cable connector. The coaxial cable connector 100 may accept a prepared coaxial cable 10, and may be operably affixed to a coaxial cable 10 so that the cable 10 is securely attached to the connector 100. The coaxial cable 10 may include a protective outer jacket 12, a conductive grounding shield 14, a dielectric foil layer 15, an interior dielectric 16 and a center conductor 18. The coaxial cable 10 may be prepared as embodied in FIG. 1 by removing the protective outer jacket 12 and drawing back the conductive grounding shield 14 to expose a portion of the dielectric foil layer 15 surrounding the interior dielectric 16. Further preparation of the embodied coaxial cable 10 may include stripping the dielectric foil layer 15 and the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 can be comprised of conductive materials suitable for providing an electrical ground connection.

Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 can be comprised of materials suitable for electrical insulation. It should be noted that the various materials of which all the various components of the coaxial cable 10 are comprised should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive grounding shield 14, dielectric foil layer 15, interior dielectric 16 and/or center conductor 18 may vary based upon generally recognized parameters corresponding to broadband communication standards and/or equipment.

Referring further to FIG. 1, the connector 100 is configured to attach to a coaxial cable interface port, such as, for example, interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 operable electrical interface with a connector 100. However, the receptacle of the interface port 20 should be formed of a conductive material. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

With continued reference to FIG. 1, an embodiment of a coaxial cable connector 100 may comprise a port coupling element 30, a post 40 having a flange 44, a connector body 50, and a fastener member 60. In another embodiment, connector 100 may comprise a connector body attached to a post, the post including a first end portion and an opposing second end portion, and a flange proximate the second end portion, a port coupling element attached to the post, the port coupling element being rotatable about the post, wherein the port coupling element has a first end and a second end, and a plurality of openings on the port coupling element, the plurality of openings extending a distance toward the first end from the second end of the port coupling element. In another exemplary embodiment, the connector 100 may comprise a connector body attached to a post, the post having a first end portion, an opposing second end portion, and a flange proximate the second end portion, the flange having an outer edge, a port coupling element rotatable about the post, wherein the port coupling element includes a first end and a second end, and a plurality of engagement fingers proximate the second end, wherein the plurality of engagement fingers are biased into a position of interference with the outer edge of the flange. In yet another embodiment, connector 100 may comprise a port coupling element attached to a post, the port coupling element having a first end, an opposing second end, and a plurality of slots axially extending through the port coupling element, wherein the port coupling element is resilient in the radial direction, and a connector body attached to the post, the post having a first end portion, an opposing second end portion, wherein a positioning of the post radially expands the port coupling element, further wherein the port coupling element exerts an opposing radial contact force against an outer edge of the post, wherein the opposing radial contact force establishes and maintains physical and electrical contact between the port coupling element and the post regardless of the axial position of the post and the port coupling element.

Furthermore, the port coupling element 30, or nut 30, or threaded nut, of embodiments of a coaxial cable connector 100 has a first end 31 and opposing second end 32. The nut 30 may be rotatably secured to the post 40 to allow for rotational movement about the post 40. For example, the nut 30 may freely rotate, or spin, about the stationary post 40. The nut 30 may comprise an internal lip 34 located proximate, or otherwise near to the second end 32 and configured to hinder axial movement of the post 40. The nut 30 may also comprise internal threading 33 extending axially from the edge of first end 31 a distance sufficient to provide operably effective threadable contact with the external threads 23 of a standard coaxial cable interface port 20. The structural configuration of the nut 30 may vary according to accommodate different functionality of a coaxial cable connector 100. For instance, the first end 31 of the nut 30 may include internal and/or external structures such as ridges grooves, curves, detents, slots, openings, chamfers, or other structural features, etc., which may facilitate the operable joining of an environmental sealing member, such as an water-tight seal, that may help prevent ingress of environmental contaminants at the first end 31 of a nut 30, when mated with an interface port 20. Moreover, the second end 32, of the nut 30 may extend a significant axial distance to reside radially extent of the connector body 50, although the extended portion of the nut 30 need not contact the connector body 50. The nut 30, or port coupling element, includes a generally axial opening, as shown in FIG. 1, and has an inner surface 35 which may include inner surfaces with internal threading 33 positioned thereon. The inner surface 35 of nut 30 may also be an inner wall, inside surface, internal surface/wall, and the like, surrounding the generally axially opening through the nut 30. In one embodiment of the inner surface 35, the inside diameter of the nut 30 at any point along the surface may be considered the inner surface 35 of the nut. In other embodiments of connector 100, the post 40 contacts the inner surface 35 of the nut 30 proximate the internal lip 34.

The nut 30 may be formed of conductive materials facilitating grounding through the nut 30. Accordingly the nut 30 may be configured to extend an electromagnetic buffer by electrically contacting conductive surfaces of an interface port 20 when a connector 100 is advanced onto the port 20. In addition, the nut 30 may be formed of both conductive and non-conductive materials. For example the external surface of the nut 30 may be formed of a polymer, while the remainder of the nut 30 may be comprised of a metal or other conductive material. Manufacture of the nut 30 may include casting, extruding, cutting, knurling, turning, tapping, drilling, injection molding, blow molding, or other fabrication methods that may provide efficient production of the component. Those in the art should appreciate the various embodiments of the nut 30 may also comprise a coupler member having no threads, but being dimensioned for operable connection to a corresponding to an interface port, such as interface port 20.

With continued reference to FIG. 1, nut 30 includes a plurality of slots 130 positioned somewhere on or around the nut 30 proximate or otherwise near the second end 32. A plurality of slots 130 may be a plurality of openings, spaces, voids, apertures, holes, cuts, channels, grooves, and the like, positioned on the nut 30 proximate or otherwise near the second end 32. For instance, the slots 130 can be axially aligned with the nut 30, and, generally, with the connector 100. Moreover, the slots 130 can axially extend through the nut 30 a distance suitable to form a biasing relationship with the underlying post 40 from the second end 32 towards the first end 31. In one embodiment, the slots 130 extend from the second end 32 to proximate or otherwise near two-thirds of the length of the nut 30. In many embodiments, the distance the slots 130 axially extend through the nut 30 may vary, depending on the amount of deflection sought when expanded and/or the amount of any reactive radially inward force needed to establish and maintain physical and electrical continuity with the post 40. A nut 30 having slots 130 axially extending too far along the nut 30 toward the first end 31 may risk a partial or significant loss in the structural integrity of the nut 30, and may not achieve the suitable amount of radial force and resiliency to bias it into a position of interference with the post 40. Those skilled in the art should appreciate that the slots 130 can be used to make the nut 30 resilient in the radial direction; therefore, slots 130 may vary in size, shape, appearance, and the like. The nut 30 may be made resilient without introducing voids between portions of the nut 30. For example, instead of voids, such as slots 130, nut 30 may have portions separated by webbing, spacers, meshing, flexible material, netting, and the like.

Moreover, the nut 30 may be made up of more than one component. For instance, the nut 30 may have a cylindrical metal threaded portion capable of mating with an interface port 20, and a polymer-based portion molded to the metal threaded portion of the nut 30, wherein the polymer-based portion may form the rest of the nut 30. The polymer-based portion may contain a plurality of slots 130 proximate the second end 32 of the nut to allow for expansion and contraction. To avoid exposure presentation of slots, a cover or sleeve may be placed over the nut 30. The sleeve may conform to the external surface of the nut, or the sleeve may be a rigid cover having its own shape and/or structure. The plurality of slots 130 can still expand and contract while the sleeve is placed over the nut 30, for example, a slight tolerance may exist between the sleeve placed over the nut 30 and the external surface of the nut 30.

Furthermore, the width of the slots 130 may vary based upon generally recognized parameters corresponding to broadband communication standards and/or equipment. A decrease in the width of the slots 130 can lead to increase in surface area of the inner surface 35 of the nut 30, and vice versa. The inner surface 35 of the nut 30 can make physical contact with the post 40, such as outer edge 45 of flange 44, the outer surface of the post 40, the angled/tapered surface of the post; therefore, the width of the slots 130 should be balanced with the amount of desired surface area of the inner surface 35 of the nut 30. One having ordinary skill in the art should also consider the structural properties of the materials used to manufacture the nut 30, and other connector 100 components, such as the modulus of elasticity of the material, ductility, yield strength, and the like, to determine the dimensions (i.e. length, width, depth) and the number of slots 130 positioned on the nut 30. Ostensibly, the slots 130 have a depth equal to the thickness of the nut 30 (i.e. from the inner surface of the nut 30 to outer surface of the nut 30). In other words, the slots 130 can be spaces where portions of the nut 30 have been removed, extruded, cut, extracted, etc. Moreover, the number of slots 130 and the axial length of the slots 130 should be optimized to provide the best balance of reliable interference, or contact, with the post 40. Other factors to consider may be achieving reduced drag, and keeping down any costs associated with the manufacture, production, and operation of the connector 100.

In an alternative embodiment, the nut 30 may include two slots 130, positioned relatively near each other, creating a single flexible finger. The reduction of slots 130 to include only two, generally narrow slots would increase the overall strength of the component. However, the single flexible finger created by the two slots 130 may still be resilient such that it radially expands outward due to interference with a post 40, constantly exerting a radially inward force against the post 40. Those skilled in the art should appreciate that the same effect may be achieved with more than two slots 130, keeping to an overall low number of total slots 130.

Referring still to FIG. 1, slotting the nut 30 makes it resilient in the radial direction. For example, the nut 30, or a portion of the nut 30, may flex, deflect, move, bend, etc., in a radially outward direction and a radially inward direction. The slots 130 allow the nut 30 to radially expand (i.e. radially outward direction) from an initial position when subjected to an external force, such as an outer surface of the post 40, including the outer edge 45 of the post 40 (while operably configured). One example of an initial position of the nut 30 may be a slightly compressed position, wherein the attachment of the nut 30 to the post 40 may require or result in a slight expansion of the nut 30. Because the nut 30 having a plurality of slots 130 is resilient, flexible, capable of deflection, etc. in the radial directions (e.g. radially inward and outward), the nut 30 may be biased into a position of interference with the post 40. For instance, the operable attachment of the nut 30 to the post 40 may slightly expand the nut 30 from a compressed or squeezed, initial position, or rest position, in a radially outward direction via the contact being made between an outer surface of the post 40 and the inner surface 35 of the nut 30. Accordingly, the resilient nut 30 may flex back, or "spring" back, exerting a constant inward radial force (i.e. a biasing force, reactive force, etc.) against an outer surface of the post, including the edge 45 of the post 40 to return to its initial position of rest, prior to the slight expansion. The constant outward radial force exerted by the nut 30 against the outer surface of the post (e.g. base of post 40, tapered surface of post 40, outer edge 45, etc.) establishes and maintains electrical continuity between the post 40 and nut 30, regardless of their axial position. The deflection, or movement, of the nut 30 in a radially outward direction based on any expansion from the post 40 need not be significant or readily apparent; a slight deflection of the nut 30 in a radially outward direction is sufficient to prompt a constant radially inward force due to the biasing relationship between the nut 30 and the post 40.

Figure 2:
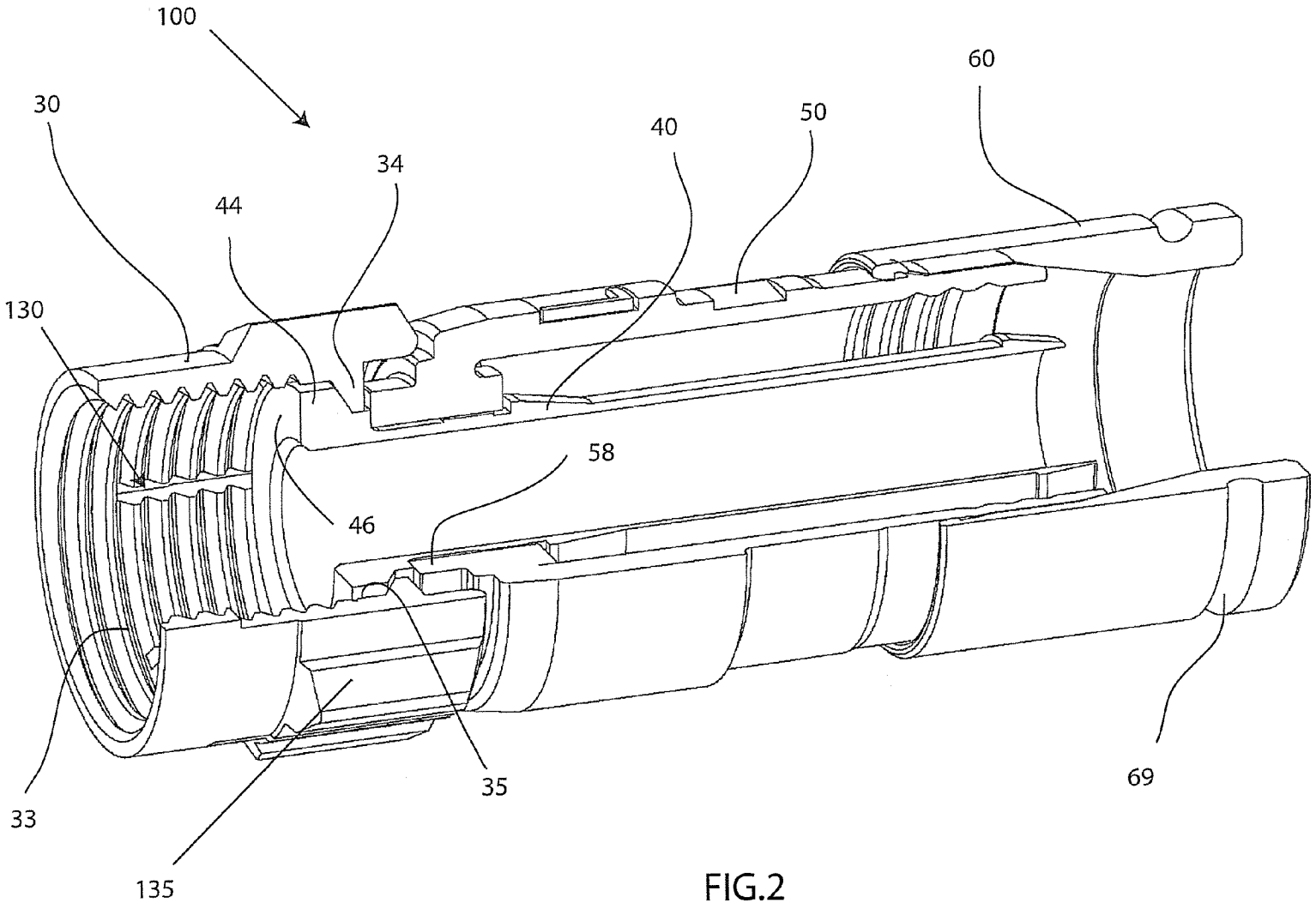
FIG. 2 depicts a perspective cut-away view of an embodiment of a connector, in accordance with the present invention.
Figure 3:
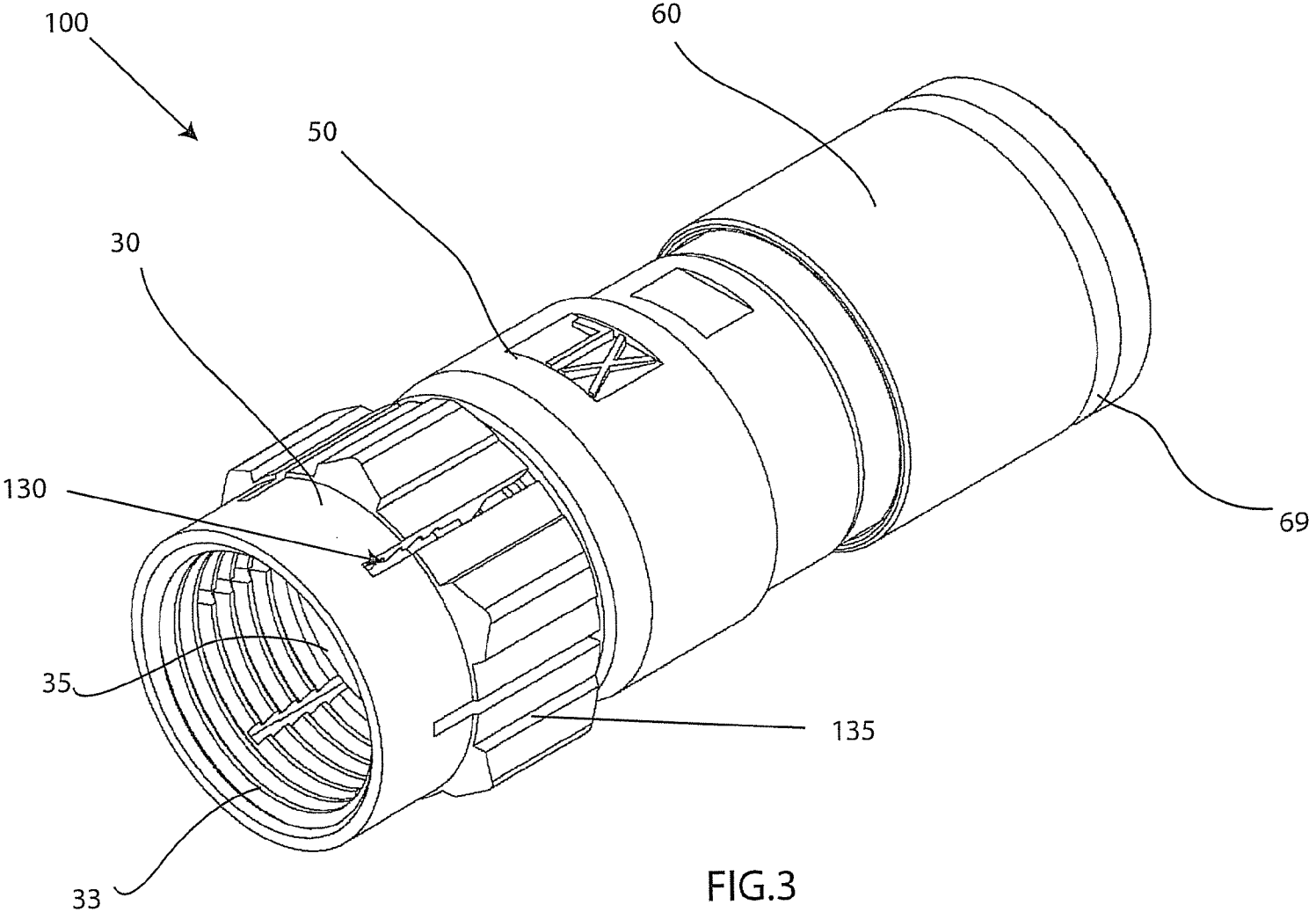
FIG. 3 depicts a perspective view of an embodiment of a port coupling element, in accordance with the present invention.

In one embodiment of connector 100, the outer diameter of the flange 44 may be slightly larger than the inner diameter of the nut 30 proximate or otherwise near the second end 32, which may require, or result in, a slight expansion of the nut 30 when the nut 30 is attached to the post 40. While operably configured, the constant biasing force of the inner surface 35 of the nut 30 against the outer surfaces of the flange 44 and post 40 (e.g. outer edge 45, tapered surface of the flange 44, outer surface of post 40, etc.) can establish and maintain physical and electrical contact between the post 40 and the nut 30, as depicted in FIGS. 2-3. The constant biasing force against the flange 44 of the post 40 helps establish and maintain physical and electrical continuity between the post 40 and the nut 30 in installation situations where it may be undesirable to fully tighten the connector 100 to a port, similar to interface port 20, for example, a consumer device where there may be a concern of the port 20 fracturing or breaking. Additionally, the constant biasing force of the slotted nut 30 helps establish and maintain physical and electrical continuity in situations where a connector 100 is unintentionally not fully tightened to a port 20. Those skilled in the art should appreciate that physical and electrical continuity between the post 40 and the nut 30 is desirable in situations involving connector 100 other than those described herein.

Figure 4:
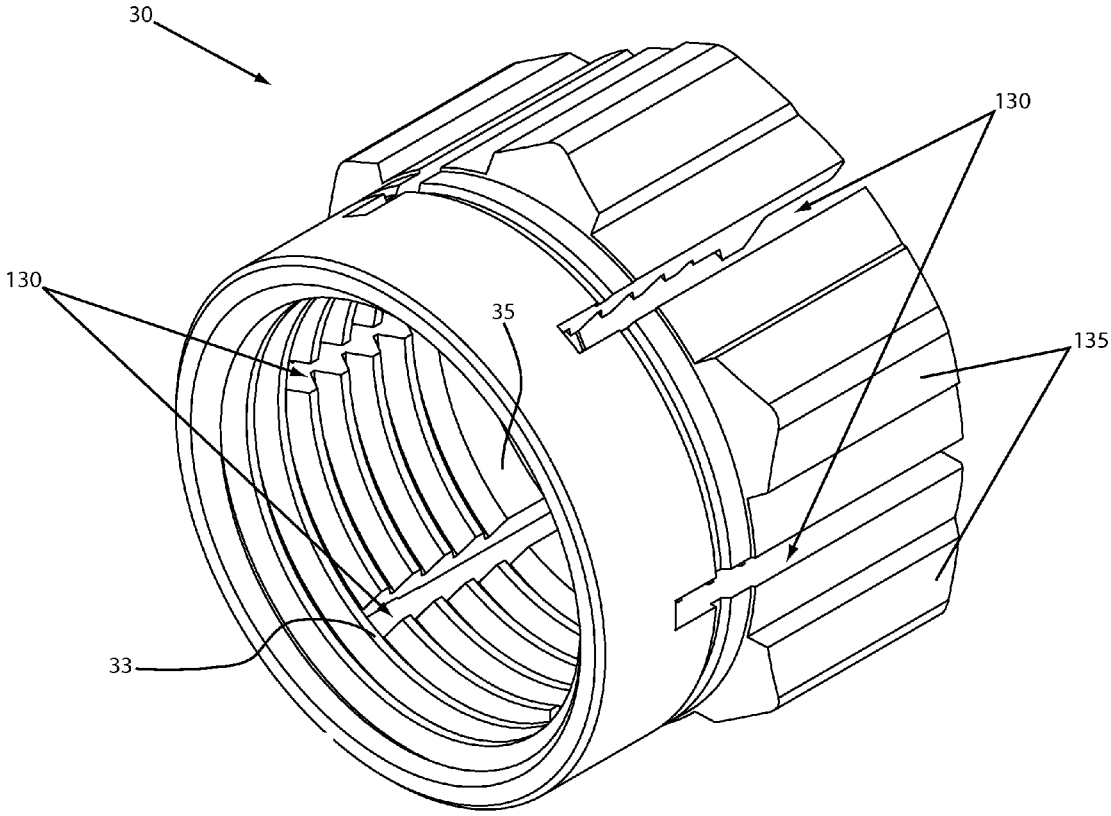
FIG. 4 depicts a perspective view of a connector having a constant contact nut, in accordance with the present invention.

With reference to FIG. 4, and continued reference to FIG. 1, another embodiment of connector 100 includes a nut 30 having a first end 31, a second end 32, and a plurality of engagement fingers 135 proximate or otherwise near the second end 32 of the nut 30. Engagement fingers 135 can be portions of the nut 30 proximate or otherwise near the second end 32 that are separated, or spaced apart, by slots 1300 running axially through the nut 30 proximate or otherwise near the second end 32. Engagement fingers 135 may also be resilient members, biasing members, fingers, biasing fingers, post fingers, teeth, engagement teeth, nut teeth, expanding members, flexible members, and the like. The number of engagement fingers 135 depends on the number of slots 130 positioned on the nut 30. For example, if the nut has six slots 130 axially extending from the second end 32, six engagement fingers 135 would be formed. Moreover, the engagement fingers 135 spaced apart by slots 130, or openings, are resilient in the radial directions (e.g. radially inward and outward). In one non-limiting example, as the nut 30 is operably attached to the post 40, the engagement fingers 135 may slightly expand radially outward to accommodate the attachment of the nut 30. When the nut 30 is attached to the post 40 (i.e. while operably configured), the resilient engagement fingers 135 should flex, compress, squeeze, contract, or "spring" back in a radially inward direction, applying a constant radial contact force against the post 40, in particular, the flange 44 or an outer surface of the post 40. The constant radial contact force applied by the engagement fingers 135 against the flange 44 may establish and maintain physical and electrical continuity between the post 40 and the nut 30. In many embodiments, the inner surface 35 of the engagement fingers 135 contact the flange 44 of the post 40. In another embodiment, the engagement fingers 135 have a biasing relationship with the post 40 to establish and maintain ground continuity throughout the connector 100.

Referring still to FIG. 1, an embodiment of a connector 100 may include a post 40. The post 40 comprises a first end 41 and opposing second end 42. Furthermore, the post 40 comprises a flange 44, such as an externally extending annular protrusion, located at the second end 42 of the post 40. The flange 44 may include a tapered surface facing the first end 41 of the post 40. Further still, an embodiment of the post 40 may include a surface feature 47 such as a lip or protrusion that may engage a portion of a connector body 50 to secure axial movement of the post 40 relative to the connector body 50. However, the post may not include such a surface feature 47, and the coaxial cable connector 100 may rely on press-fitting and friction-fitting forces and/or other component structures to help retain the post 40 in secure location both axially and rotationally relative to the connector body 50. The location proximate or otherwise near where the connector body is secured relative to the post 40 may include surface features 43, such as ridges, grooves, protrusions, or knurling, which may enhance the secure location of the post 40 with respect to the connector body 50. Additionally, the post 40 includes a mating edge 46, which may be configured to make physical and electrical contact with a corresponding mating edge of an interface port 20. The post 40 should be formed such that portions of a prepared coaxial cable 10 including the dielectric foil layer 15, the dielectric 16 and center conductor 18 can pass axially into the second end 42 and/or through a portion of the tube-like body of the post 40. Moreover, the post 40 should be dimensioned such that the post 40 may be inserted into an end of the prepared coaxial cable 10, around the dielectric foil layer 15 surrounding the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

Referring again to FIG. 1, embodiments of a coaxial cable connector, such as connector 100, may include a connector body 50. The connector body 50 may comprise a first end 51 and opposing second end 52. Moreover, the connector body may include a post mounting portion 57 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector 100. In addition, the connector body 50 may include an outer annular recess 58 located proximate or near the first end 51 of the connector body 50. Furthermore, the connector body 50 may include a semi-rigid, yet compliant outer surface 55, wherein the outer surface 55 may be configured to form an annular seal when the second end 52 is deformably compressed against a received coaxial cable 10 by operation of a fastener member 60. The connector body 50 may include an external annular detent 53 located proximate or close to the second end 52 of the connector body 50. Further still, the connector body 50 may include internal surface features, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, embodiments of a coaxial cable connector 100 may include a fastener member 60. The fastener member 60 may have a first end 61 and opposing second end 62. In addition, the fastener member 60 may include an internal annular protrusion located proximate the first end 61 of the fastener member 60 and configured to mate and achieve purchase with the annular detent 53 on the outer surface 55 of connector body 50. Moreover, the fastener member 60 may comprise a central passageway 65 defined between the first end 61 and second end 62 and extending axially through the fastener member 60. The central passageway 65 may comprise a ramped surface which may be positioned between a first opening or inner bore having a first diameter positioned proximate with the first end 61 of the fastener member 60 and a second opening or inner bore having a second diameter positioned proximate with the second end 62 of the fastener member 60. The ramped surface may act to deformably compress the outer surface 55 of a connector body 50 when the fastener member 60 is operated to secure a coaxial cable 10. For example, the narrowing geometry will compress squeeze against the cable, when the fastener member is compressed into a tight and secured position on the connector body. Additionally, the fastener member 60 may comprise an exterior surface feature 69 positioned proximate with or close to the second end 62 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate significantly close to the nut 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

Another manner in which the coaxial cable connector 100 may be fastened to a received coaxial cable 10 may also be similar to the way a cable is fastened to a connector having an insertable compression sleeve that is pushed into the connector body 50 to squeeze against and secure the cable 10. The coaxial cable connector 100 includes an outer connector body 50 having a first end 51 and a second end 52. The body 50 at least partially surrounds a tubular inner post 40. The tubular inner post 40 has a first end 41 including a flange 44 and a second end 42 configured to mate with a coaxial cable 10 and contact a portion of the outer conductive grounding shield or sheath 14 of the cable 10. The connector body 50 is secured relative to a portion of the tubular post 40 proximate or close to the first end 41 of the tubular post 40 and cooperates, or otherwise is functionally located in a radially spaced relationship with the inner post 40 to define an annular chamber with a rear opening. A tubular locking compression member may protrude axially into the annular chamber through its rear opening. The tubular locking compression member may be slidably coupled or otherwise movably affixed to the connector body 50 to compress into the connector body and retain the cable 10 and may be displaceable or movable axially or in the general direction of the axis of the connector 100 between a first open position (accommodating insertion of the tubular inner post 40 into a prepared cable 10 end to contact the grounding shield 14), and a second clamped position compressibly fixing the cable 10 within the chamber of the connector 100, because the compression sleeve is squeezed into retraining contact with the cable 10 within the connector body 50. A port coupling element, or nut 30, at the front end of the inner post 40 serves to attach the connector 100 to an interface port.

Referring now to FIGS. 1-4, a first embodiment of a method for maintaining ground continuity between the free-spinning nut 30 and the stationary post 40 of a connector 100 may comprise the steps of providing a connector body 50 attached to a post 40, the post 40 having a first end 41, an opposing second end 42, and port coupling element 30 having a plurality of openings 130 positioned thereon, and biasing the port coupling element 30 in a position of interference with the post 40. The method may also include inner surface 35 of the port coupling element 30 exerts a constant radial contact force against a flange 44, wherein the flange 44 is attached to the post 40, and a fastener member 60, wherein the fastener member 60 is configured to operate on and deform the connector body 50 sealingly compressing it against and affixing it to a coaxial cable 10. The method may include steps with reference to the multiple embodiments described herein.

A second embodiment of a method of maintaining electrical continuity with a port may comprise the steps of providing a connector body 50 attached to a post 40, the post 40 having a first end portion 41 and an opposing second end portion 42, a port coupling element 30 rotatable about the post 40, wherein the port coupling element 30 has a first end 31 and a second end 32, and a plurality of engagement fingers 135 proximate the second end 32, the plurality of engagement fingers 135 being resilient in a radial direction, and expanding the plurality of engagement fingers 135 in a radially outward direction, wherein the expansion of the plurality of engagement fingers 135 by a positioning of the post 40 results in the plurality of engagement fingers 135 exerting a radially inward force against the post 40, wherein the radially inward force against the post 40 establishes and maintains physical and electrical continuity between the post 40 and the port coupling element 30 regardless of the relative axial position between the post 40 and the port coupling element 30. The method may also include wherein the inner surface 35 of each of the plurality of engagement fingers 135 constantly contact the outer surface of the post 40 when the plurality of engagement fingers 135 exert the radially inward force against the post 40, and a fastener member 60, wherein the fastener member 60 is configured to operate on and deform the connector body 50 sealingly compressing it against and affixing it to a coaxial cable 10, and spacing the plurality of engagement fingers 135 apart by axially aligned slots 130 positioned on the nut 30 proximate the second end 32.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A coaxial cable connector comprising:

a connector body attached to a post, the post including a first end portion and an opposing second end portion, and a flange proximate the second end portion;

a port coupling element rotatably attached to the post, the port coupling element has a first end and a second end, wherein the port coupling element includes internal threads configured to threadably mate with a port; and a plurality of openings on the port coupling element, the plurality of openings extending a distance toward the first end from the second end of the port coupling element.

2. The connector of claim 1, wherein an inner surface of the port coupling element exerts a constant radial force against an outer edge of the post to establish and maintain physical and electrical continuity between the post and the port coupling element.

3. The connector of claim 1, wherein the plurality of openings are axially extending slots across the port coupling element which allow radial movement of the port coupling element proximate the second end.

4. The connector of claim 1, further comprising:

a fastener member, wherein the fastener member is configured to operate on and deform the connector body sealingly compressing it against and affixing it to a coaxial cable.

5. A coaxial cable connector comprising:

a connector body attached to a post, the post having a first end portion, an opposing second end portion, and a flange proximate the second end portion, the flange having an outer edge;

a port coupling element rotatable about the post, wherein the port coupling element includes a first end and an opposing second end, the first end of the port coupling element configured to threadably mate with a port; and a plurality of engagement fingers proximate the second end, wherein the plurality of engagement fingers are biased into a position of interference with the post.

6. The connector of claim 5, wherein an inner surface of each of the plurality of engagement fingers exerts a constant radial force against the outer edge of the flange to establish and maintain physical and electrical continuity between the post and the port coupling element.

7. The connector of claim 5, further comprising:

a fastener member, wherein the fastener member is configured to operate on and deform the connector body sealingly compressing it against and affixing it to a coaxial cable.

8. The connector of claim 5, wherein the plurality of engagement fingers are spaced apart by axially aligned slots positioned on the port coupling element proximate the second end.

9. A coaxial cable connector comprising:

a slotted port coupling element attached to a post, the slotted port coupling element having a first end, an opposing second end, wherein the slotted port coupling element is resilient in the radial direction and includes internal threads configured to threadably mate with a port; and a connector body attached to the post, the post having a first end portion, an opposing second end portion, wherein a positioning of the post radially expands the slotted port coupling element, further wherein the slotted port coupling element exerts an opposing radial contact force against an outer surface of the post; and wherein the opposing radial contact force establishes and maintains physical and electrical contact between the slotted port coupling element and the post regardless of the axial position of the post and the slotted port coupling element.

10. The connector of claim 9, wherein a plurality of slots are axially aligned openings that space apart portions of the slotted port coupling element.

11. The connector of claim 9, further comprising:

a fastener member, wherein the fastener member is configured to operate on and deform the connector body sealingly compressing it against and affixing it to a coaxial cable.

12. The connector of claim 9, wherein the opposing radial contact force is constant.

13. A method for establishing and maintaining electrical continuity in a connector comprising:

providing a connector body attached to a post, the post having a first end and an opposing second end; and a port coupling element having a plurality of openings positioned thereon, wherein the port coupling element includes internal threads configured to threadably mate with a port; and biasing the port coupling element in a position of interference with the post to establish and maintain electrical continuity.

14. The method of claim 13, wherein an inner surface of the port coupling element exerts a constant radial contact force against an outer edge of a flange, wherein the flange is attached to the post.

15. The method of claim 13, further comprising:

a fastener member, wherein the fastener member is configured to operate on and deform the connector body sealingly compressing it against and affixing it to a coaxial cable.

16. The method of claim 13, wherein the port coupling element is resilient.

17. The method of claim 13, wherein the plurality of openings are axially aligned slots, that space apart portions of the port coupling elements.

18. A method for maintaining electrical continuity with a port comprising:

providing a connector body attached to a post, the post having a first end portion and an opposing second end portion; and a port coupling element rotatable about the post, wherein the port coupling element has a first end, a second end, internal threads configured to threadably mate with a port, and a plurality of engagement fingers proximate the second end, the plurality of engagement fingers being resilient in a radial direction; and expanding the plurality of engagement fingers in a radially outward direction, wherein the expansion of the plurality of engagement fingers by a positioning of the post results in the plurality of engagement fingers exerting a radially inward force against the post; and wherein the radially inward force against the post establishes and maintains physical and electrical continuity between the post and the port coupling element regardless of the relative axial position between the post and the port coupling element.

19. The method of claim 18, wherein the inner surface of each of the plurality of engagement fingers constantly contact the outer surface of the post when the plurality of engagement fingers exert the radially inward force against the post.

20. The method of claim 18, further comprising:

a fastener member, wherein the fastener member is configured to operate on and deform the connector body sealingly compressing it against and affixing it to a coaxial cable.

21. The method of claim 18, wherein the plurality of engagement fingers are spaced apart by axially aligned slots positioned on the port coupling element proximate the second end.

* * * * *